US011045029B2

(12) United States Patent
Gray et al.

(10) Patent No.: US 11,045,029 B2
(45) Date of Patent: Jun. 29, 2021

(54) FITTED COASTER FOR A BEVERAGE CONTAINER

(71) Applicants: Austin Gray, San Antonio, TX (US); Steven Eggleston, Fullerton, CA (US)

(72) Inventors: Austin Gray, San Antonio, TX (US); Steven Eggleston, Fullerton, CA (US)

( * ) Notice: Subject to any disclaimer, the term of this patent is extended or adjusted under 35 U.S.C. 154(b) by 218 days.

(21) Appl. No.: 16/132,058

(22) Filed: Sep. 14, 2018

(65) Prior Publication Data

US 2019/0387909 A1 Dec. 26, 2019

Related U.S. Application Data

(63) Continuation-in-part of application No. 29/654,131, filed on Jun. 21, 2018, now Pat. No. Des. 901,989.

(51) Int. Cl.

| | |
|---|---|
| ***A47G 23/02*** | (2006.01) |
| ***A47G 23/032*** | (2006.01) |
| ***B65D 81/38*** | (2006.01) |
| *G09F 23/06* | (2006.01) |

(52) U.S. Cl.

CPC ..... *A47G 23/032* (2013.01); *B65D 81/3876* (2013.01); *G09F 23/06* (2013.01)

(58) Field of Classification Search

CPC ..... A47G 23/032; A47G 2023/0291; A47G 23/0216; A47G 23/0266; B65D 81/3876; B65D 81/3888; B65D 81/3886; B65D 81/3848; B65D 81/386; B65D 81/38; B65D 5/36; B65D 5/3628; G09F 23/06

USPC ..... 220/738, 739, 903, 737; 229/403

See application file for complete search history.

(56) References Cited

U.S. PATENT DOCUMENTS

| | | | | |
|---|---|---|---|---|
| 1,917,953 | A | 7/1933 | Davis | |
| D97,347 | S | 10/1935 | Gambell | |
| 3,161,394 | A | 12/1964 | Savitt | |
| D354,420 | S * | 1/1995 | Sharp | D7/607 |
| 5,425,473 | A | 6/1995 | Kvalheim | |
| 5,425,497 | A | 6/1995 | Sorensen | |
| D411,079 | S | 6/1999 | Graham | |
| 6,026,983 | A | 2/2000 | Graham | |
| 6,601,728 | B1 | 8/2003 | Newkirk et al. | |
| 7,000,801 | B2 | 2/2006 | Rodriguez | |
| 7,228,987 | B2 | 6/2007 | Jones | |
| 7,264,134 | B2 | 9/2007 | Tulp | |
| D610,411 | S | 2/2010 | Holladay | |
| 8,056,757 | B2 | 11/2011 | Mansour et al. | |
| D670,542 | S | 11/2012 | Lee | |

(Continued)

*Primary Examiner* — James N Smalley
*Assistant Examiner* — Elizabeth J Volz
(74) *Attorney, Agent, or Firm* — Plumsea Law Group, LLC

(57) ABSTRACT

A fitted coaster for a beverage container. The coaster may include a base and a first sidewall extending substantially perpendicularly from the base, the first sidewall, comprising: a first lateral edge and a second lateral edge opposite the first lateral edge; and a first top edge and a first bottom edge opposite the first top edge. The coaster may also include a second sidewall extending substantially perpendicularly from the base, the second sidewall, comprising: a third lateral edge and a fourth lateral edge opposite the third lateral edge; and a second top edge and a second bottom edge opposite the second top edge, wherein the first lateral edge is attached to the third lateral edge and wherein the second lateral edge is attached to the fourth lateral edge. The coaster may further include a first notch disposed along the first bottom edge.

20 Claims, 18 Drawing Sheets

(56) References Cited

U.S. PATENT DOCUMENTS

| | | | | |
|---|---|---|---|---|
| 8,672,176 | B2 | 3/2014 | Sayasithsena | |
| D704,006 | S | 5/2014 | Gonzales | |
| 9,254,053 | B2 | 2/2016 | Arzumanyan et al. | |
| 9,533,794 | B2 | 1/2017 | Vara | |
| 9,795,235 | B1 | 10/2017 | Bouse | |
| D802,375 | S | 11/2017 | Kao | |
| D803,636 | S | 11/2017 | Kiefer et al. | |
| 9,826,850 | B2 | 11/2017 | Hasani | |
| 9,856,068 | B2 | 1/2018 | Jody | |
| 2003/0111475 | A1* | 6/2003 | Cheng | B65D 81/3876 220/739 |
| 2003/0146228 | A1 | 8/2003 | Davis et al. | |
| 2007/0138188 | A1 | 6/2007 | Mace et al. | |
| 2009/0020676 | A1 | 1/2009 | Curry | |
| 2009/0078594 | A1 | 3/2009 | Lookholder | |
| 2010/0001012 | A1 | 1/2010 | Wilson | |
| 2010/0059393 | A1 | 3/2010 | Hechtman | |
| 2011/0192750 | A1 | 8/2011 | Kokin | |
| 2012/0234846 | A1 | 9/2012 | Costanzo, Jr. | |
| 2013/0075412 | A1 | 3/2013 | Schminke | |
| 2014/0091099 | A1 | 4/2014 | Prchal | |
| 2016/0120348 | A1 | 5/2016 | Ko | |
| 2016/0174742 | A1* | 6/2016 | Berthelot | A47G 23/0216 220/739 |
| 2016/0194113 | A1 | 7/2016 | Aquino | |
| 2016/0288948 | A1 | 10/2016 | Kiefer et al. | |
| 2017/0020319 | A1 | 1/2017 | Detweiler | |
| 2017/0156527 | A1 | 6/2017 | Vara | |
| 2017/0332817 | A1 | 11/2017 | Nellis | |
| 2018/0078068 | A1 | 3/2018 | Cronin | |

* cited by examiner

FITTED COASTER FOR A BEVERAGE CONTAINER

CROSS-REFERENCE TO RELATED APPLICATION(S)

This application is a continuation-in-part of co-pending design application Ser. No. 29/654,131 filed Jun. 21, 2018, and entitled Fitted Coaster, the disclosure of which is incorporated herein by reference in its entirety.

TECHNICAL FIELD

The present disclosure generally relates to coasters for beverage containers. More specifically, the present disclosure generally relates to a fitted coaster for beverage containers.

BACKGROUND

Flat coasters help capture moisture, such as condensation, from beverage containers set on top of the coaster. Flat coasters are typically set on a surface, such as a table, and the beverage container, such as a glass, is set on top of the flat coaster. Flat coasters do not reliably adhere to beverage containers such that the coasters travel with the beverage container as the container is moved. Flat coasters also do not continuously prevent condensation from dripping off the beverage container while the beverage container is lifted from a surface. For example, when a user lifts a beverage container to take a sip, the flat coaster does not continuously prevent condensation from dripping off the beverage container. In another example, when a user takes a beverage container from one location, such as a home, to another location, such as a vehicle, the flat coaster does not continuously prevent condensation from dripping off the beverage container during travel. Flat coasters also serve as an advertisement piece. However, when the beverage container is on top of the flat coaster, the product or event being advertised is covered up and therefore rendered useless as an advertisement.

There is a need in the art for a system and method that addresses the shortcomings discussed above.

SUMMARY

A fitted coaster for a beverage container is disclosed. The fitted coaster solves the problems discussed above by receiving bottom and side surfaces of beverage containers. The fitted coaster works with a variety of beverage containers. For example, the fitted coaster works with cups, glasses, cans, bottles, and tumblers, etc. The fitted coaster has sidewalls and a base that receives the bottom and side surfaces of beverage containers in a manner that captures moisture, including condensation forming on the outer surfaces of the beverage container. A plurality of notches can also help the fitted coaster grip the surface of a beverage container as well as allow the base to be folded inward without obstruction of the side walls. The side walls also serve as advertisement space that will not be covered up when used with a beverage container. The bottom or base of a fitted beverage coaster also serves as advertisement space to be seen when an individual tips the beverage container to take a sip, making the bottom side of the fitted beverage coaster visible to the surrounding environment. Further, the base may be easily removed and, therefore, may be used as a promotional piece.

The present disclosure is directed to a fitted coaster for a beverage container. The coaster may include a base and a first sidewall extending substantially perpendicularly from the base, the first sidewall, comprising: a first lateral edge and a second lateral edge opposite the first lateral edge; and a first top edge and a first bottom edge opposite the first top edge. The coaster may also include a second sidewall extending substantially perpendicularly from the base, the second sidewall, comprising: a third lateral edge and a fourth lateral edge opposite the third lateral edge; and a second top edge and a second bottom edge opposite the second top edge, wherein the first lateral edge is attached to the third lateral edge and wherein the second lateral edge is attached to the fourth lateral edge. The coaster may further include a first notch disposed along the first bottom edge.

In addition, the present disclosure is directed to a fitted coaster for a beverage container including a circular base and a first sidewall extending substantially perpendicularly from the base, the first sidewall, comprising: a first lateral edge and a second lateral edge opposite the first lateral edge; and a first top edge and a first bottom edge opposite the first top edge. The coaster may also include a second sidewall extending substantially perpendicularly from the base, the second sidewall, comprising: a third lateral edge and a fourth lateral edge opposite the third lateral edge; and a second top edge and a second bottom edge opposite the second top edge, wherein the first lateral edge is attached to the third lateral edge and wherein the second lateral edge is attached to the fourth lateral edge.

In addition, the present disclosure is directed to a fitted coaster for a beverage container including a circular base and a first sidewall extending from the circular base, the first sidewall, comprising: a first lateral edge and a second lateral edge opposite the first lateral edge; and a first top edge and a first bottom edge opposite the first top edge, wherein the first top edge is curved, the first bottom edge is straight, and the first bottom edge is connected to the circular base. The coaster may also include a second sidewall extending from the circular base, the second sidewall, comprising: a third lateral edge and a fourth lateral edge opposite the third lateral edge; and a second top edge and a second bottom edge opposite the second top edge, wherein the second top edge is curved, the second bottom edge is straight, and the second bottom edge is connected to the circular base.

Other systems, methods, features and advantages of the disclosure will be, or will become, apparent to one of ordinary skill in the art upon examination of the following figures and detailed description. It is intended that all such additional systems, methods, features and advantages be included within this description and this summary, be within the scope of the disclosure, and be protected by the following claims.

While various embodiments are described, the description is intended to be exemplary, rather than limiting and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature or element of any embodiment may be used in combination with or substituted for any other feature or element in any other embodiment unless specifically restricted.

This disclosure includes and contemplates combinations with features and elements known to the average artisan in the art. The embodiments, features and elements that have been disclosed may also be combined with any conventional features or elements to form a distinct invention as defined by the claims. Any feature or element of any embodiment may also be combined with features or elements from other inventions to form another distinct invention as defined by the claims. Therefore, it will be understood that any of the features shown and/or discussed in the present disclosure may be implemented singularly or in any suitable combination. Accordingly, the embodiments are not to be restricted except in light of the attached claims and their equivalents. Also, various modifications and changes may be made within the scope of the attached claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DESCRIPTION OF EMBODIMENTS

Figure 1:
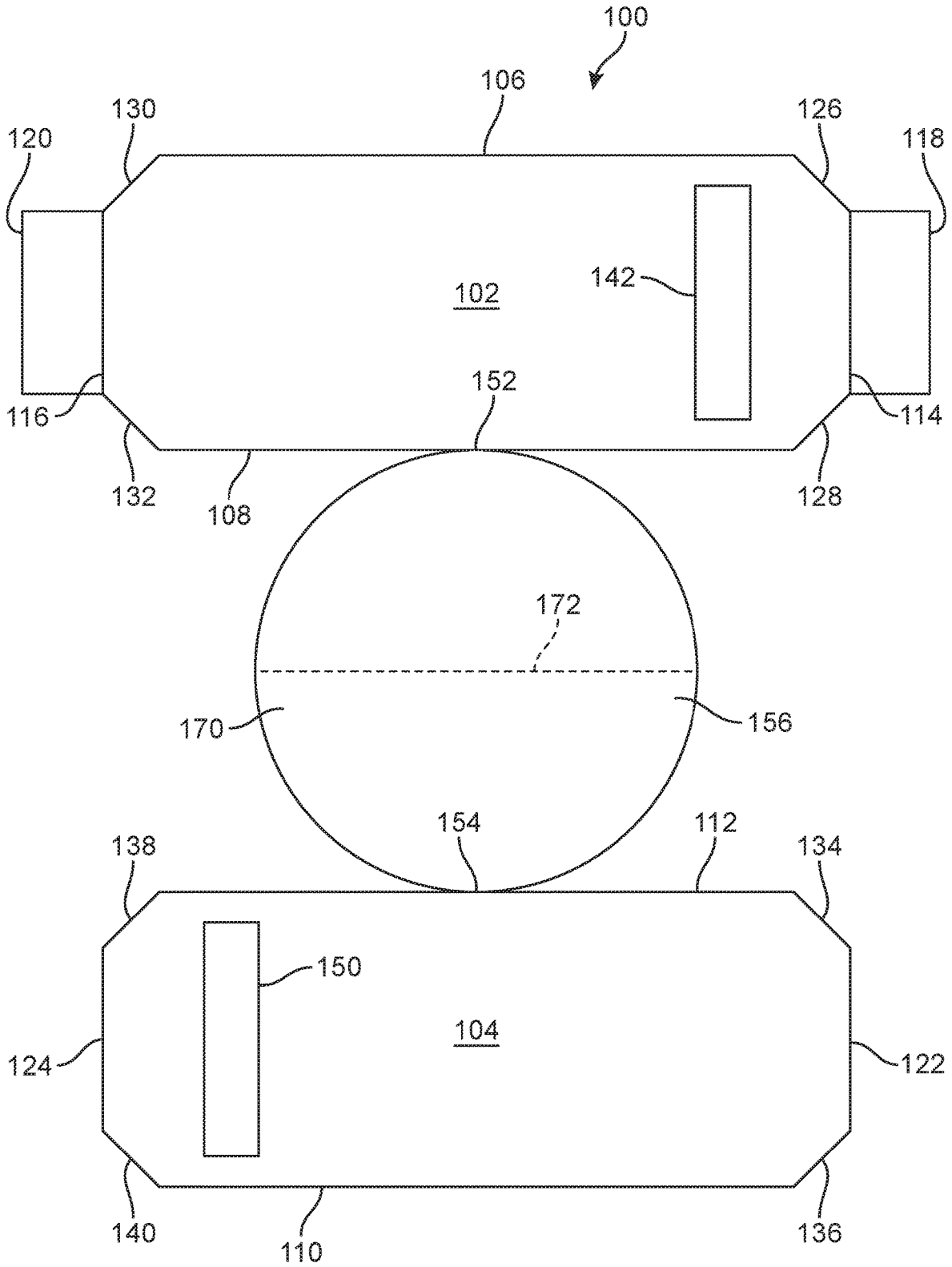
FIG. 1 is a plan view of a blank for a fitted coaster.
Figure 2:
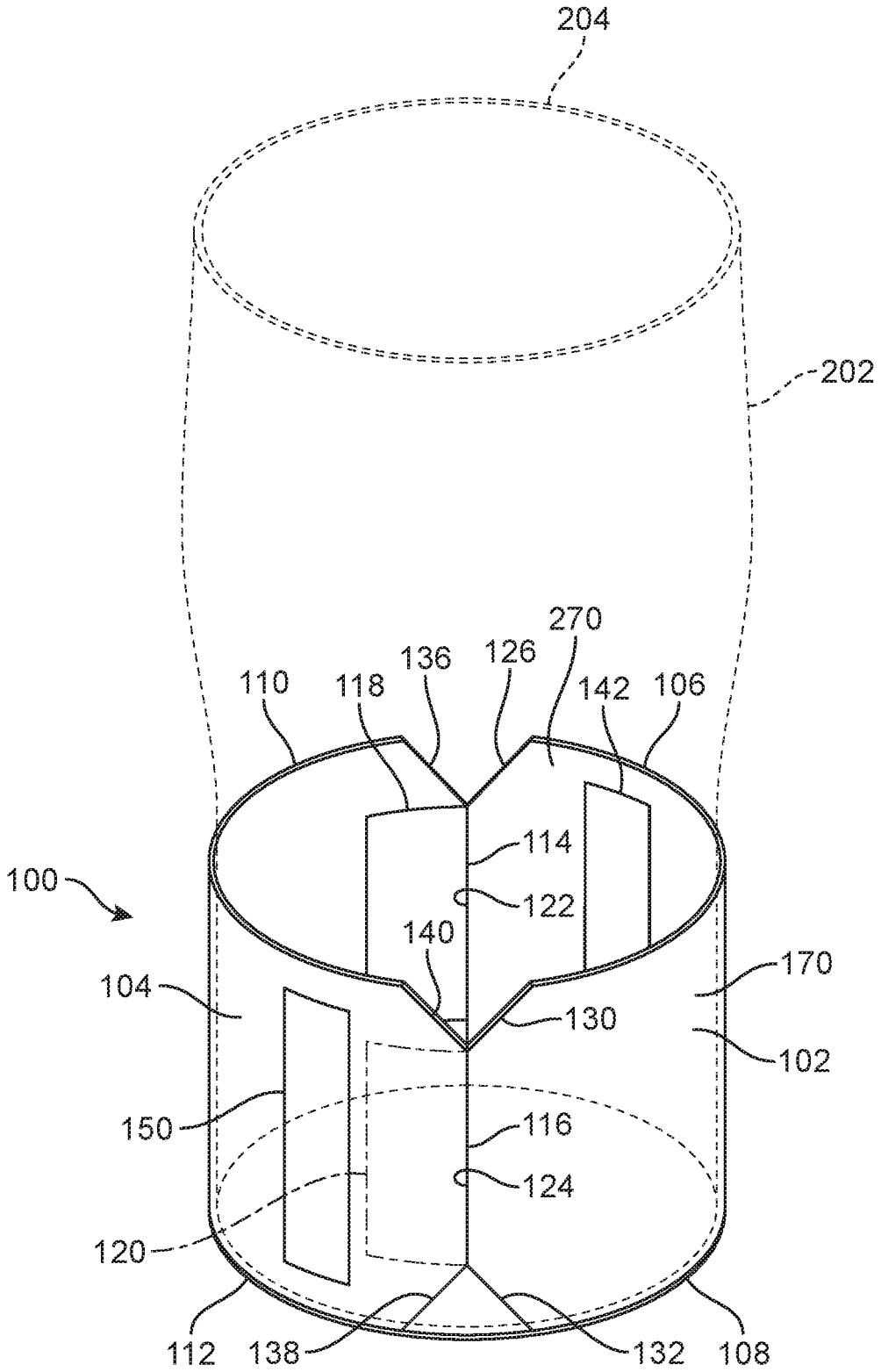
FIG. 2 is a perspective view of the assembled fitted coaster from FIG. 1 in combination with a beverage container.
Figure 3:
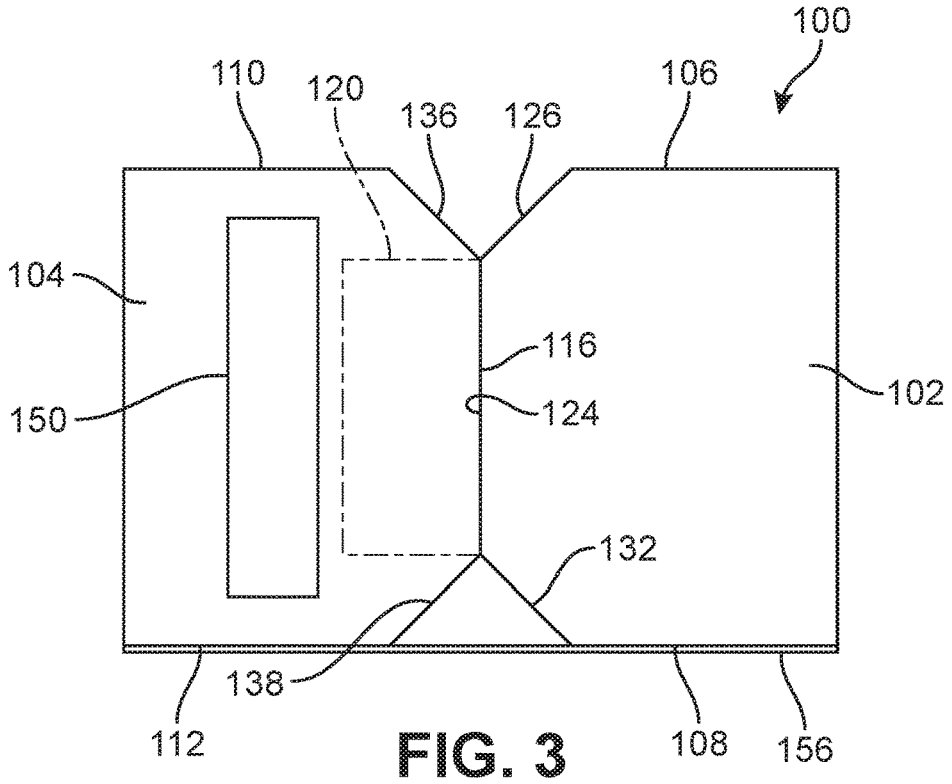
FIG. 3 is a front elevation of the assembled fitted coaster.
Figure 10:
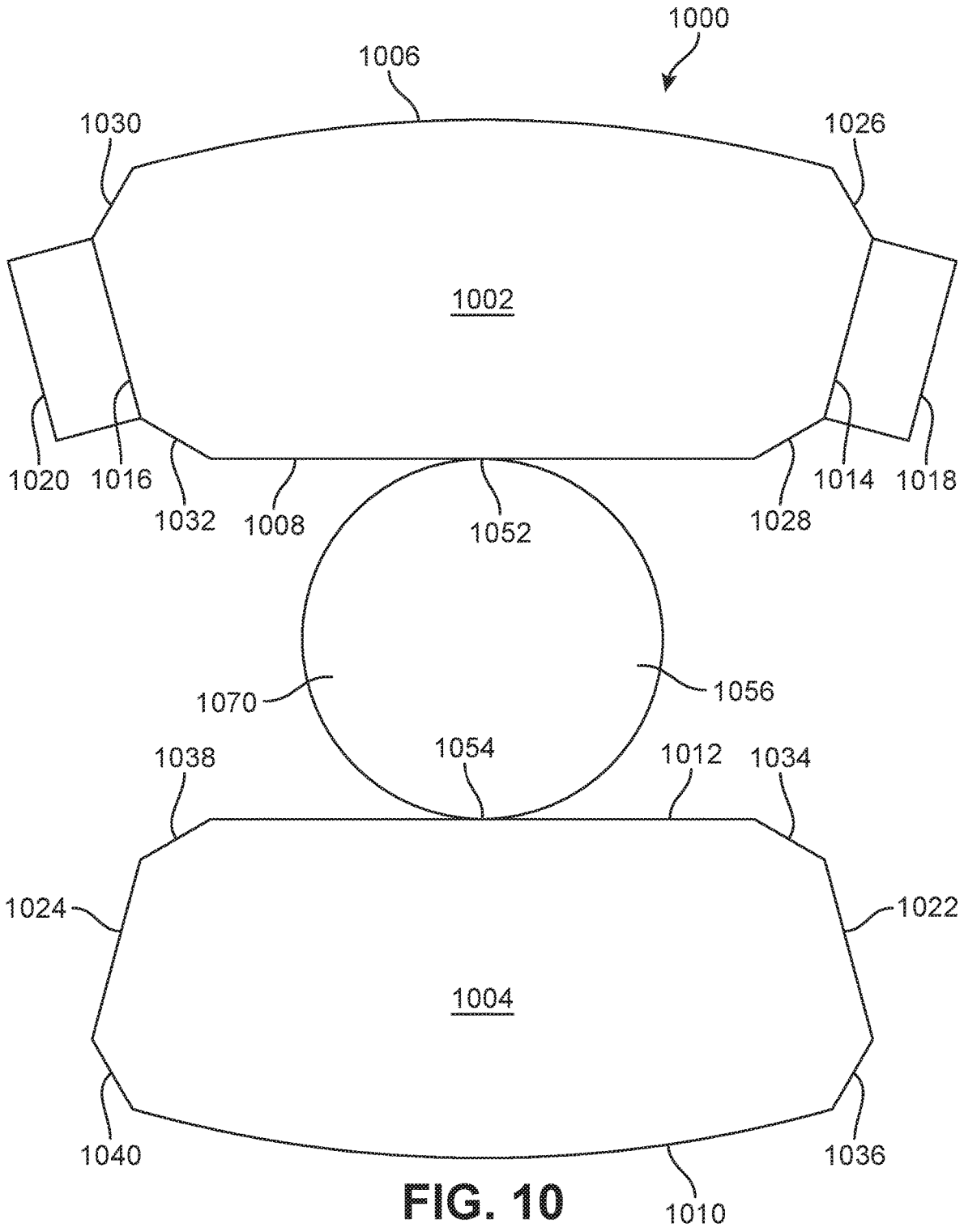
FIG. 10 is another embodiment of a blank for a fitted coaster.
Figure 11:
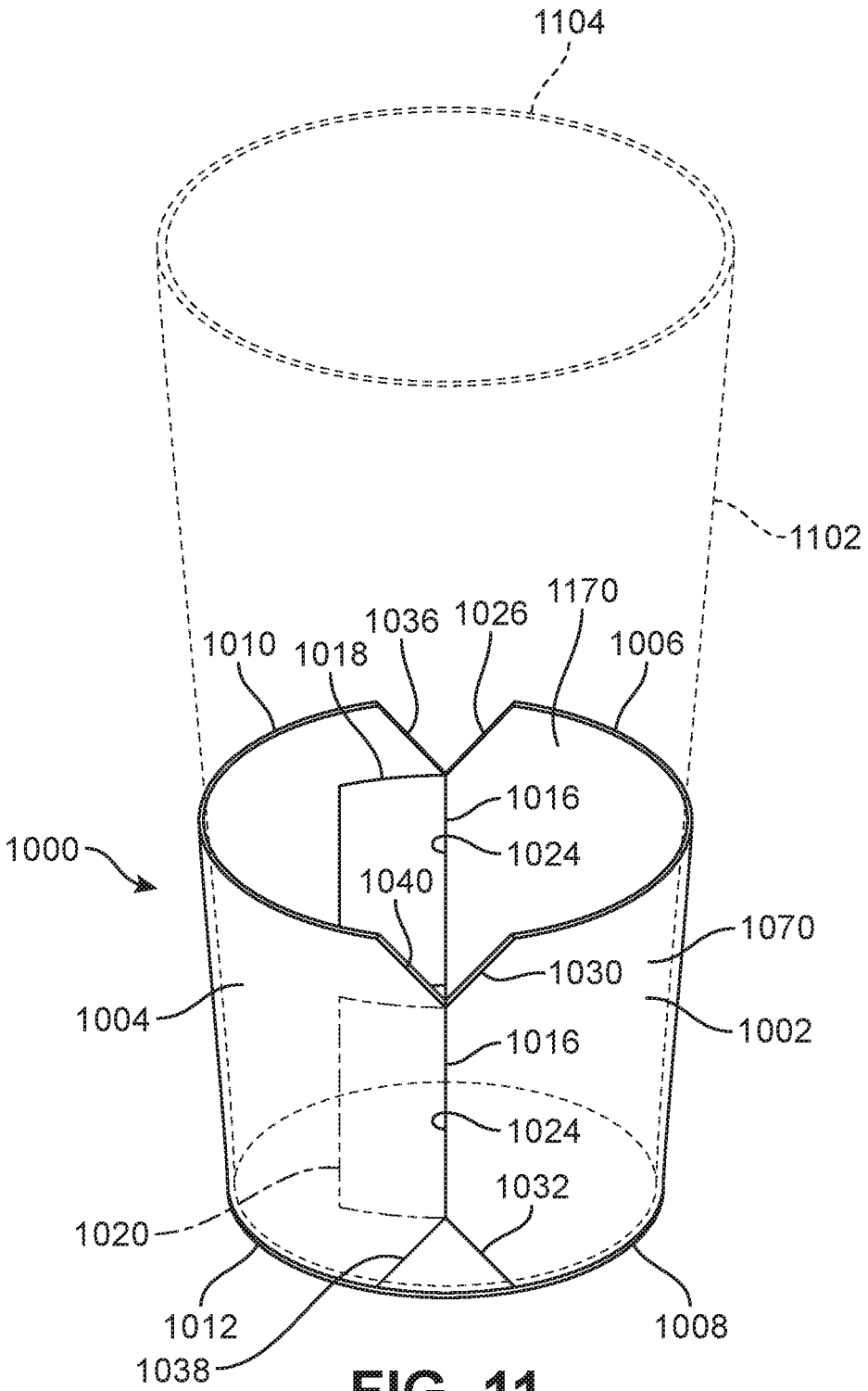
FIG. 11 is a perspective view of the fitted coaster from FIG. 10 assembled and in combination with a tapered beverage container.
Figure 12:
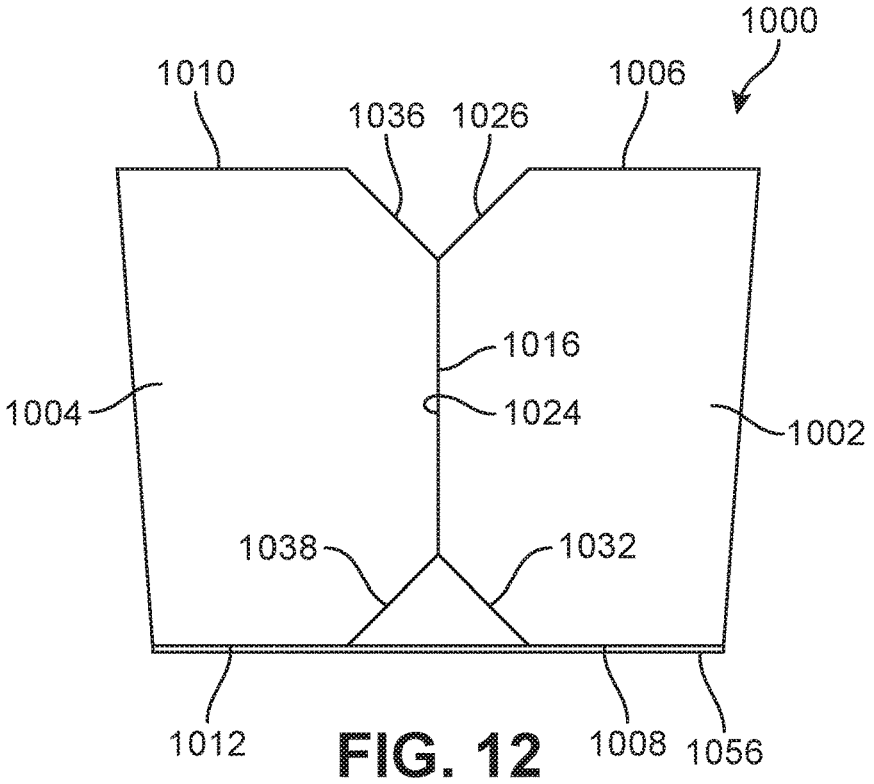
FIG. 12 is a front elevation view of the assembled fitted coaster.

A fitted coaster for a beverage container is disclosed. The fitted coaster may include a flat blank that is assembled to have a shape corresponding to a beverage container. For example, FIG. 1 illustrates an embodiment of a blank for a fitted coaster 100 and FIG. 2 shows fitted coaster 100 in an assembled condition. In another example, FIG. 10 illustrates an embodiment of a blank for a fitted coaster 1000 and FIG. 11 shows fitted coaster 1000 in an assembled condition. The view in FIG. 1 shows the part of the blank that will become an outer surface 170 of fitted coaster 100 when fitted coaster 100 is assembled. Similarly, the view in FIG. 10 shows the part of the blank that will become an outer surface 1070 of fitted coaster 1000 when fitted coaster 1000 is assembled.

The fitted coaster may include a base. For example, as shown in FIG. 1, fitted coaster 100 includes a base 156. In another example, as shown in FIG. 10, fitted coaster 1000 includes a base 1056. The fitted coaster may include a first sidewall and a second sidewall that is opposite the first sidewall. For example, as shown in FIG. 1, fitted coaster 100 includes a first sidewall 102 and a second sidewall 104 that is opposite first sidewall 102. In another example, as shown in FIG. 10, fitted coaster 1000 includes a first sidewall 1002 and a second sidewall 1004 that is opposite first sidewall 1002. The first sidewall may extend from the base. For example, as shown in FIG. 1, first sidewall 102 extends from base 156. The second sidewall may extend from the base. For example, as shown in FIG. 1, second sidewall 104 extends from base 156 in a position opposite first sidewall 102. In another example, as shown in FIG. 10, second sidewall 1004 extends from base 1056 in a position opposite first sidewall 1002. In some embodiments, the sidewalls may provide a surface for advertisements or designs.

In some embodiments, the blank for the fitted coaster is all one, monolithic piece of material. In such embodiments, the base and sidewalls are formed from a single piece of material. This one-piece structure simplifies assembly by preventing the need to attach multiple parts together. In other embodiments, the base and sidewalls are formed from various materials secured together.

In some embodiments, when assembled, the first sidewall and second sidewall may both extend perpendicularly from the base. For example, as shown in FIG. 2, first sidewall 102 and second sidewall 104 both extend perpendicularly from base 156. In other embodiments, when assembled, the first sidewall and second sidewall may both extend substantially perpendicularly from the base. For example, as shown in FIG. 11, first sidewall 1002 and second sidewall 1004 both extend substantially perpendicularly from base 1056.

The first sidewall may include a first top edge and a first bottom edge that is opposite the first top edge. For example, as shown in FIG. 1, first sidewall 102 includes a first top edge 106 and a first bottom edge 108 that is opposite top edge 106. In another example, as shown in FIG. 10, first sidewall 1002 includes a first top edge 1006 and a first bottom edge 1008 that is opposite top edge 1006. The second sidewall may include a second top edge and a second bottom edge that is opposite the first top edge. For example, second sidewall 104 includes a second top edge 110 and a second bottom edge 112. In another example, second sidewall 1004 includes a second top edge 1010 and a second bottom edge 1012. It is understood that the terms "top" and "bottom" here are used to help in understanding where parts of the fitted coaster are located when the fitted coaster is assembled and situated right-side-up with the base on a surface and an opening of the fitted coaster facing upward. For example, FIG. 2 shows fitted coaster 100 of FIG. 1 assembled and receiving a beverage container 202 having a rim 204 that is right-side-up.

The first bottom edge may connect to the base along a first connection zone. For example, first bottom edge 108 connects to base 156 along a first connection zone 152. In another example, first bottom edge 1008 connects to base 1056 along a first connection zone 1052. In some cases, the first bottom edge directly connects to the base along the first connection zone. For example, first bottom edge 108 directly connects to base 156 along first connection zone 152 without a flange or other component spacing first bottom edge 108 from base 156. Rather, first bottom edge 108 directly contacts base 156 such that first bottom edge 108 and base 156 share first connection zone 152.

The second bottom edge may connect to the base along a second connection zone. For example, second bottom edge 112 directly connects to base 156 along a second connection zone 154. In another example, second bottom edge 1012 directly connects to base 1056 along a second connection zone 1054. In some cases, the second bottom edge directly connects to the base along the second connection zone. For example, second bottom edge 112 directly connects to base 156 along second connection zone 154 without a flange or other component spacing second bottom edge 114 from base 156. Rather, second bottom edge 114 directly contacts base 156 such that second bottom edge 114 and base 156 share second connection zone 154.

The base of fitted coaster may have a circular shape. For example, base 156 has a circular shape. In another example, base 1056 has a circular shape. In some embodiments, the base may have a substantially circular shape. In the context of this disclosure, substantially circular means more circular than not. For example, an oval may be substantially circular. In another example, the base may have a straight first connection zone and a straight second connection zone that gives the base two straight sides. In such an embodiment, the curved edges connecting the straight first connection zone and straight second connection zone make up more of the base than the straight first connection zone and straight second connection zone such that the base is substantially circular.

In some embodiments, the first bottom edge and the second bottom edge may be straight. For example, as shown in FIG. 1, first bottom edge 108 and second bottom edge 112 are straight. In another example, as shown in FIG. 10, first bottom edge 1008 and second bottom edge 1012 are straight. A straight first bottom edge and a straight second bottom edge cause the bottom edges to be in contact with the base when the fitted coaster is in the assembled condition. For example, as shown in FIG. 2, first bottom edge 108 and second bottom edge 112 are in contact with base 156. In another example, as shown in FIG. 11, first bottom edge 1008 and second bottom edge 1012 are in contact with base 1056. The contact between the first and second bottom edges with the base is discussed in more detail below.

When assembled, the first top edge and the second top edge form a lip of the fitted coaster when in the assembled condition. For example, as shown in FIG. 2, first top edge 106 and second top edge 110 form a lip of fitted coaster 100. In another example, as shown in FIG. 11, first top edge 1006 and second top edge 1010 form a lip of fitted coaster 1000. In some embodiments, the first top edge and the second top edge may both be straight. For example, as shown in FIG. 1, first top edge 106 and second top edge 110 are both straight. A straight first top edge and a straight second top edge cause the lip to have the same diameter as the base, such that the assembled fitted coaster has a cylindrical shape. For example, as shown in FIG. 2, fitted coaster 100 has a cylindrical shape. Such a cylindrically shaped fitted coaster may receive cylindrical shapes. For example, beverage container 202 has a cylindrical base that is received by fitted coaster 100.

In other embodiments, the first top edge and the second top edge may both be curved. For example, as shown in FIG. 10, first top edge 1006 and second top edge 1010 are both curved. A curved first top edge and a curved second top edge cause the lip to have a larger diameter than the base, such that the assembled fitted coaster has a frustoconical shape. For example, as shown in FIG. 11, fitted coaster 1000 has a frustoconical shape. In some embodiments, the top edges may be larger than the bottom edges. Having larger top edges than bottom edges also contributes to a frustoconical shape. For example, as shown in FIG. 10, first top edge 1006 is wider than first bottom edge 1008, and second top edge 1010 is wider than second bottom edge 1012. The larger the difference in width between the top edges and the bottom edges, the more the dramatically frustoconical shape tapers.

In some embodiments, the first bottom edge may be parallel to the first top edge. For example, as shown in FIG. 1, first top edge 106 is parallel to first bottom edge 108. In some embodiments, the second bottom edge may be parallel to the second top edge. For example, as shown in FIG. 1, second top edge 106 is parallel to second bottom edge 112.

The first sidewall may include a first lateral edge and a second lateral edge. For example, first sidewall 102 includes a first lateral edge 114 and a second lateral edge 116 that is opposite first lateral edge 114. In another example, first sidewall 1002 includes a first lateral edge 1014 and a second lateral edge 1016 that is opposite first lateral edge 1014. In some embodiments, the first lateral edge is parallel to the second lateral edge. For example, first lateral edge 114 is parallel to second lateral edge 116. The first lateral edge may include a first slanted edge and a second slanted edge. For example, first lateral edge 114 includes a first slanted edge 126 and a second slanted edge 128 that is opposite first slanted edge 126. In another example, first lateral edge 1014 includes a first slanted edge 1026 and a second slanted edge 1028 that is opposite first slanted edge 1026. In some embodiments, the first slanted edge may be a mirror image of the second slanted edge. In some embodiments, the first slanted edge may have the same length and shape as the second slanted edge.

The second lateral edge may include a third slanted edge and a fourth slanted edge. For example, second lateral edge 116 includes a third slanted edge 130 and a fourth slanted edge 132 that is opposite third slanted edge 130. In another example, second lateral edge 1016 includes a third slanted edge 1030 and a fourth slanted edge 1032 that is opposite third slanted edge 1030. In some embodiments, the third slanted edge may be a mirror image of the fourth slanted edge. In some embodiments, the third slanted edge may have the same length and shape as the fourth slanted edge.

The second sidewall may include a third lateral edge and a fourth lateral edge. For example, second sidewall 104 includes a third lateral edge 122 and a fourth lateral edge 124 that is opposite third lateral edge 122. In another example, second sidewall 1004 includes a third lateral edge 1022 and a fourth lateral edge 1024 that is opposite third lateral edge 1022. The third lateral edge may include a fifth slanted edge and a sixth slanted edge. For example, third lateral edge 122 includes a fifth slanted edge 134 and a sixth slanted edge 136 that is opposite fifth slanted edge 134. In another example, third lateral edge 1022 includes a fifth slanted edge 1034 and a sixth slanted edge 1036 that is opposite fifth slanted edge 1034. In some embodiments, the fifth slanted edge may be a mirror image of the sixth slanted edge. The fifth slanted edge may have the same length and shape as the sixth slanted edge.

The fourth lateral edge may include a seventh slanted edge and an eighth slanted edge. For example, fourth lateral edge 124 includes a seventh slanted edge 138 and an eighth slanted edge 140 that is opposite seventh slanted edge 138. In another example, fourth lateral edge 1024 includes a seventh slanted edge 1038 and an eighth slanted edge 1040 that is opposite seventh slanted edge 1038. In some embodiments, the seventh slanted edge may be a mirror image of eighth slanted edge. In some embodiments, the seventh slanted edge may have the same length and shape as the eighth slanted edge.

The first slanted edge and the sixth slanted edge may together form a first notch when the fitted coaster is in the assembled condition. For example, as shown in FIG. 2, first slanted edge 126 and sixth slanted edge 136 together form a first notch when the fitted coaster is in the assembled condition. In another example, as shown in FIG. 11, first slanted edge 1026 and sixth slanted edge 1036 together form a first notch when the fitted coaster is in the assembled condition. The first notch may be formed along the first top edge. The first notch may be formed along the second top edge.

Figure 4:
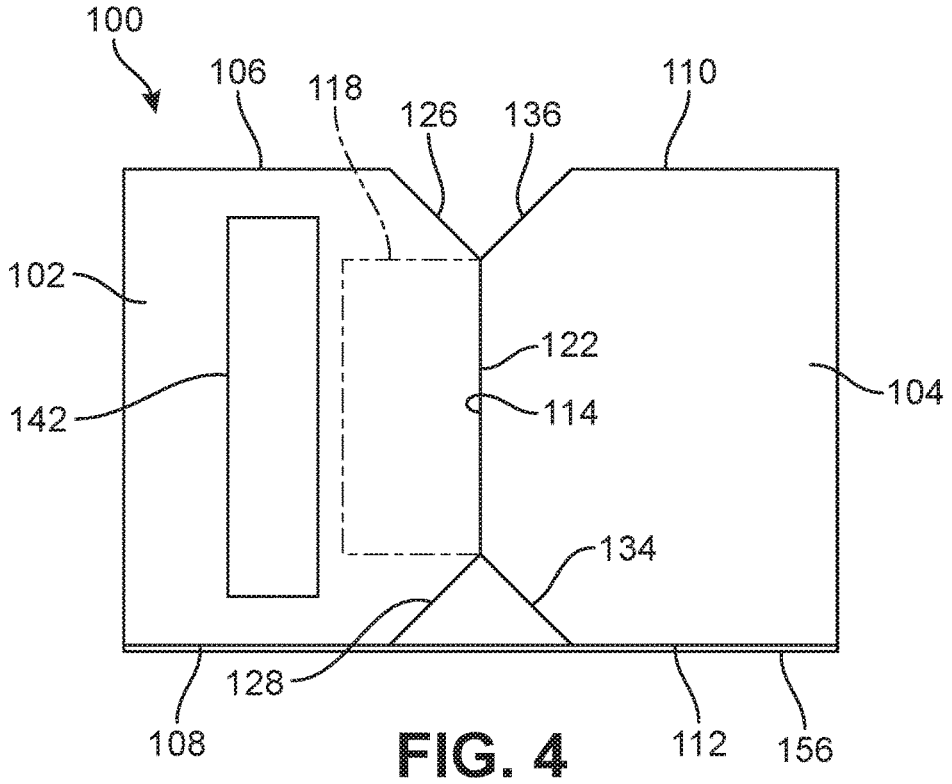
FIG. 4 is a rear elevation of the assembled fitted coaster.
Figure 5:
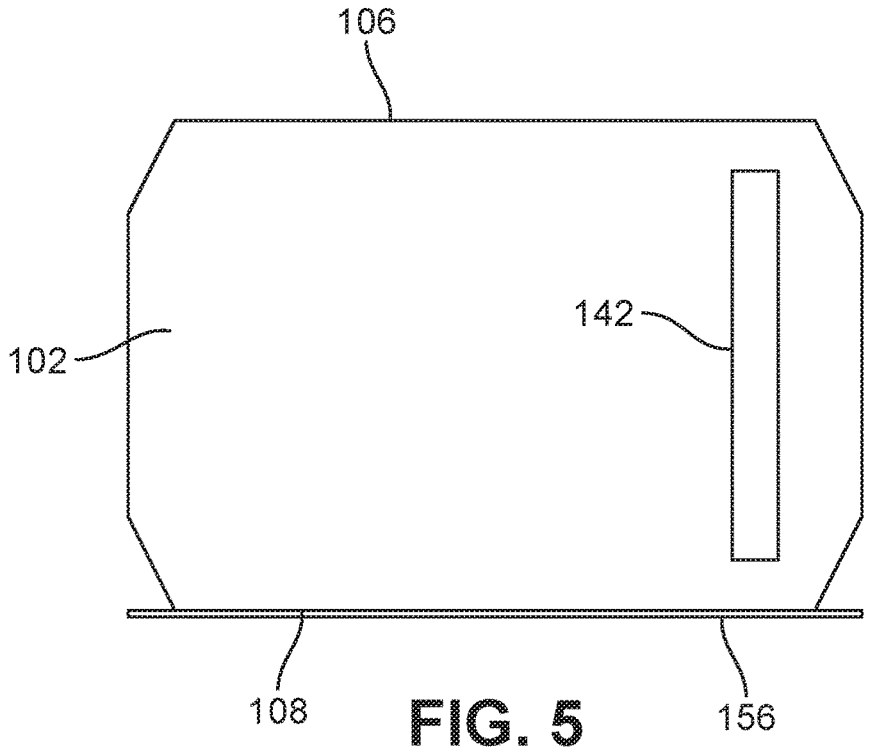
FIG. 5 is a side elevation of the assembled fitted coaster.
Figure 6:
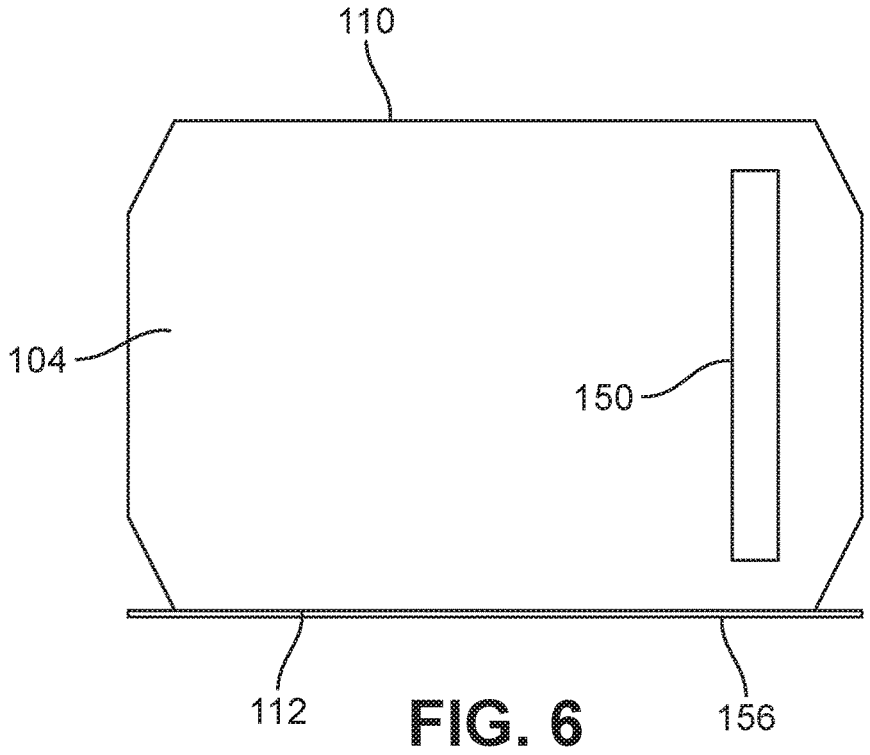
FIG. 6 is a side elevation view of the assembled fitted coaster.
Figure 7:
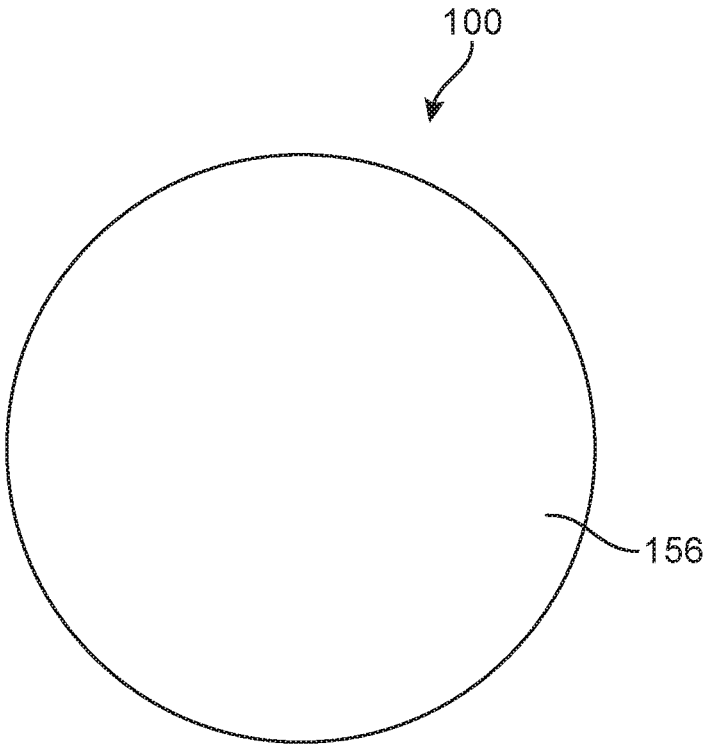
FIG. 7 is a bottom elevation view of the assembled fitted coaster.
Figure 8:
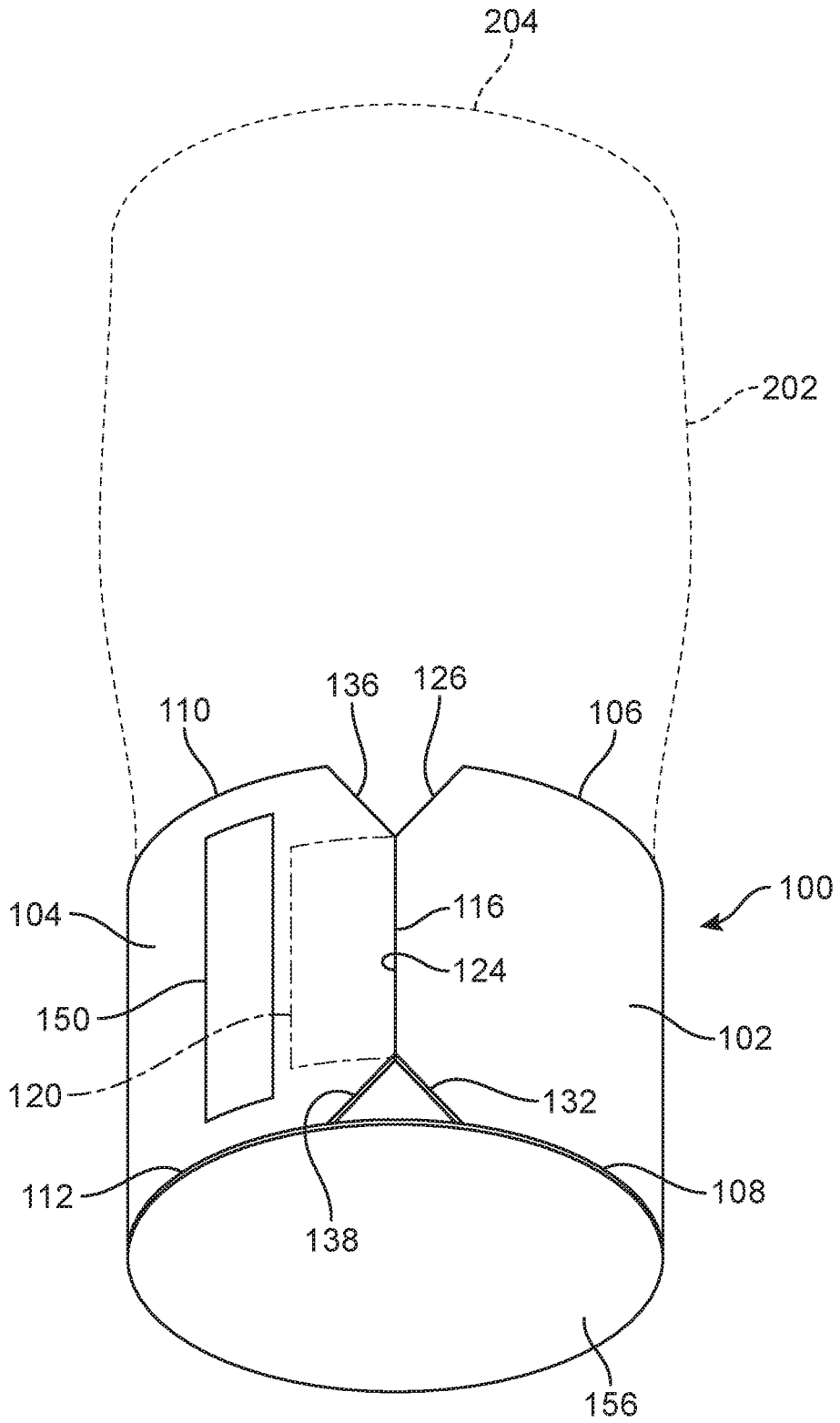
FIG. 8 is a bottom perspective view of the assembled fitted in combination with a beverage container.
Figure 13:
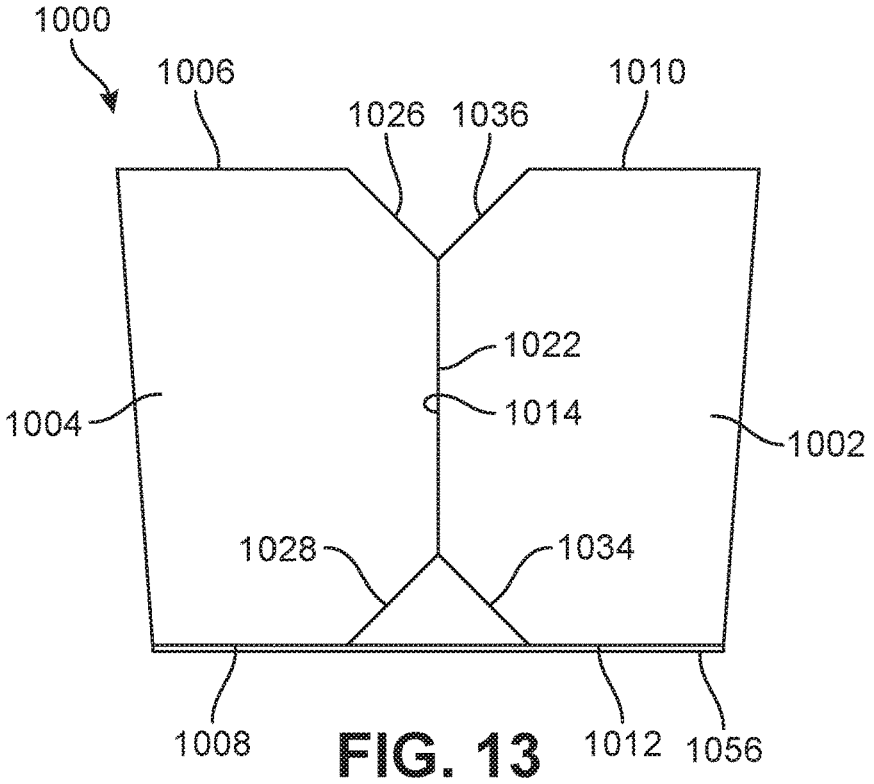
FIG. 13 is a rear elevation view of the assembled fitted coaster.
Figure 14:
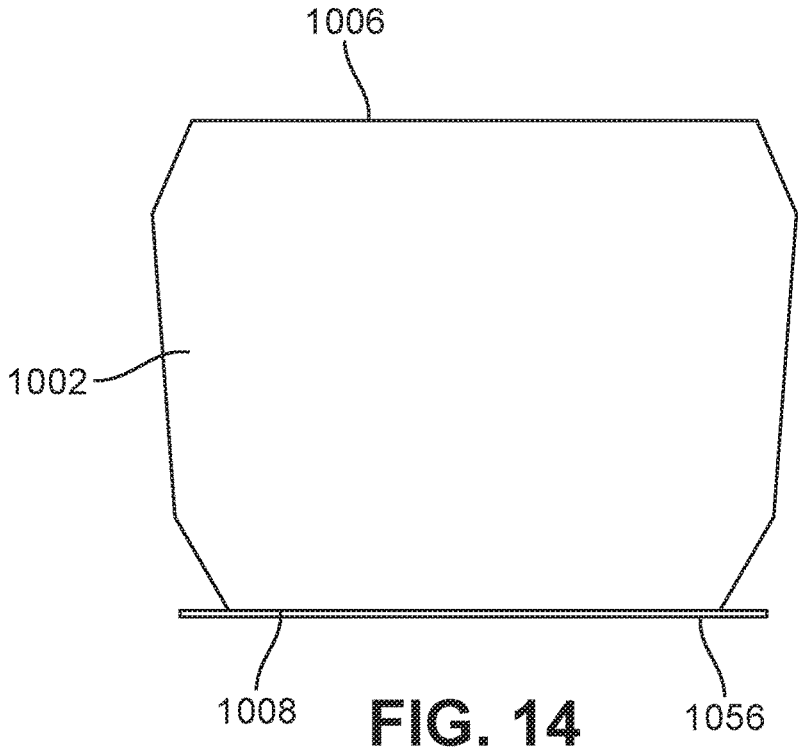
FIG. 14 is a side elevation view of one side of the assembled fitted coaster.
Figure 15:
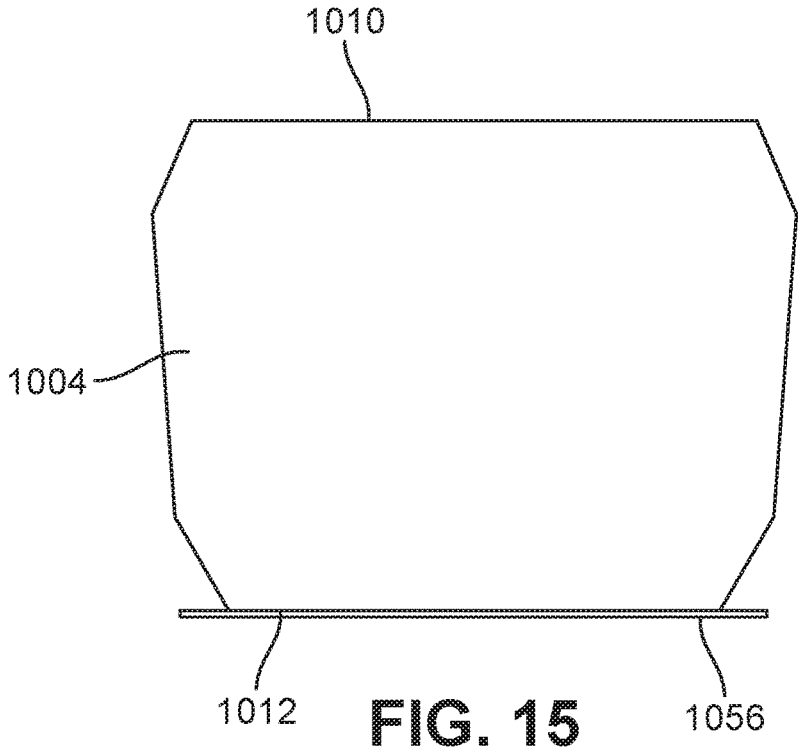
FIG. 15 is a side elevation view of the opposite side of the assembled fitted coaster.
Figure 16:
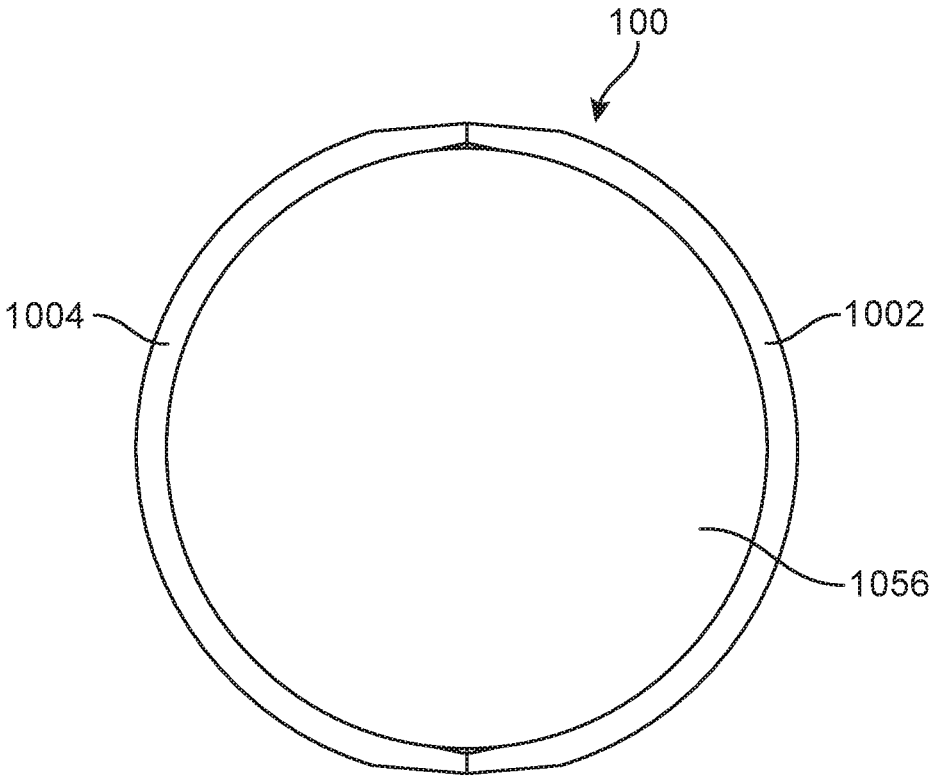
FIG. 16 is a bottom elevation view of the assembled fitted coaster.
Figure 17:
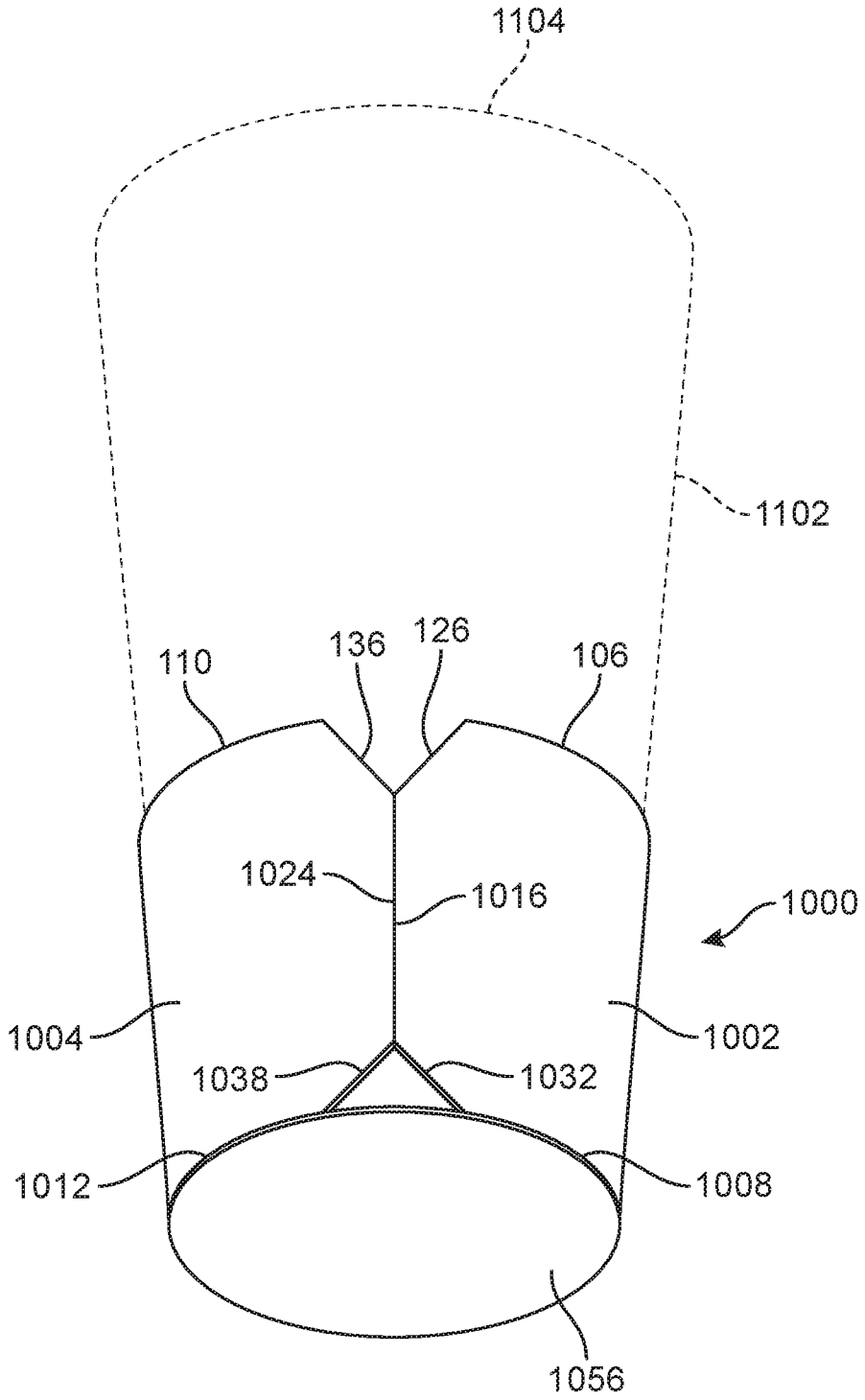
FIG. 17 is a bottom perspective view of the assembled fitted coaster in combination with a tapered beverage container.

The second slanted edge and the fifth slanted edge may together form a second notch when the fitted coaster is in the assembled condition. For example, as shown in FIG. 4, second slanted edge 128 and fifth slanted edge 134 together form a second notch when the fitted coaster is in the assembled condition. In another example, as shown in FIG. 13, second slanted edge 1028 and fifth slanted edge 1034 together form a second notch when the fitted coaster is in the assembled condition. The second notch may be formed along the first bottom edge. The second notch may be formed along the second bottom edge. In some embodiments, the second notch may be disposed opposite the first notch.

The third slanted edge and the eighth slanted edge may together form a third notch when the fitted coaster is in the assembled condition. For example, as shown in FIG. 2, third slanted edge 130 and eighth slanted edge 140 together form a third notch when the fitted coaster is in the assembled condition. In another example, as shown in FIG. 11, third slanted edge 1030 and eighth slanted edge 1040 together form a third notch when the fitted coaster is in the assembled condition. The third notch may be formed along the first top edge. The third notch may be formed along the second top edge. In some embodiments, the third notch may be disposed opposite the first notch.

The fourth slanted edge and the seventh slanted edge may together form a fourth notch when the fitted coaster is in the assembled condition. For example, as shown in FIG. 2, fourth slanted edge 132 and seventh slanted edge 138 together form a fourth notch when the fitted coaster is in the assembled condition. In another example, as shown in FIG. 11, fourth slanted edge 1032 and seventh slanted edge 1038 together form a fourth notch when the fitted coaster is in the assembled condition. The fourth notch may be formed along the first bottom edge. The fourth notch may be formed along the second bottom edge. In some embodiments the fourth notch may be disposed opposite the third notch. In some embodiments, the fourth notch may be disposed opposite the first notch.

As discussed below, providing one or more notches can help with folding and unfolding the fitted coaster. Additionally, one or more notches can make the fitted coaster have a better grip on a beverage container. This better grip prevents a beverage container from slipping out of the fitted container.

The notches shown in the drawings are v-shaped. However, it is understood that the notches may have other shapes in other embodiments. The shape of the notches may depend on the shape of the slanted edges that form the notches. For example, if the slanted edges are curved instead of straight, then the notches would be u-shaped.

The first sidewall may be unattached from the base at a first unattached region disposed between the first connection zone and the second notch formed on the bottom edge. For example, first sidewall 102 may be unattached from base 156 at a first unattached region disposed between first connection zone 152 and the second notch formed by second slanted edge 128 and fifth slanted edge 134. In another example, first sidewall 1002 may be unattached from base 1056 at a first unattached region disposed between first connection zone 1052 and the second notch formed by second slanted edge 1028 and fifth slanted edge 1034. The first sidewall may contact the base along the first unattached region. This contact is caused by the bottom edges being straight and the base being directly connected to first sidewall without any spacing. A tight fit between the bottom edges and the base helps trap moisture/condensation within the fitted coaster.

The first sidewall may be unattached from the base at the second unattached region disposed between the first connection zone and a fourth notch formed on the bottom edge. For example, first sidewall 102 may be unattached from base 156 at a second unattached region disposed between first connection zone 152 and the fourth notch formed by fourth slanted edge 132 and seventh slanted edge 138. In another example, first sidewall 1002 may be unattached from base 1056 at a second unattached region disposed between first connection zone 1052 and the fourth notch formed by fourth slanted edge 1032 and seventh slanted edge 1038. The first sidewall may contact the base along the second unattached region. This contact is caused by the bottom edges being straight and the base being directly connected to first sidewall without any spacing. A tight fit creating contact between the bottom edges and the base helps trap moisture/condensation within the fitted coaster.

The second sidewall may be unattached from the base at a third unattached region disposed between the second connection zone and the second notch formed on the bottom edge. For example, second sidewall 104 may be unattached from base 156 at a second unattached region disposed between second connection zone 154 and the second notch formed by second slanted edge 128 and fifth slanted edge 134. In another example, second sidewall 1004 may be unattached from base 1056 at a second unattached region disposed between second connection zone 1054 and the second notch formed by second slanted edge 1028 and fifth slanted edge 1034. The second sidewall may contact the base along the third unattached region. This contact is caused by the bottom edges being straight and the base being directly connected to first sidewall without any spacing. A tight fit creating contact between the bottom edges and the base helps trap moisture/condensation within the fitted coaster.

The second sidewall may be unattached from the base at a fourth unattached region disposed between the second connection zone and the fourth notch formed on the bottom edge. For example, second sidewall 104 may be unattached from base 156 at a fourth unattached region disposed between second connection zone 154 and the fourth notch formed by fourth slanted edge 132 and seventh slanted edge 138. In another example, second sidewall 1004 may be unattached from base 1056 at a fourth unattached region disposed between second connection zone 1054 and the fourth notch formed by fourth slanted edge 1032 and seventh slanted edge 1038. The first sidewall may contact the base along the second unattached region. This contact is caused by the bottom edges being straight and the base being directly connected to first sidewall without any spacing. A tight fit creating contact between the bottom edges and the base helps trap moisture/condensation within the fitted coaster.

In some embodiments, the fitted coaster includes tabs. For example, first lateral edge 114 includes a first tab 118. First tab 118 extends from first lateral edge 114. In some embodiments, the first tab is an extension of the first lateral edge. In such embodiments, the blank for the fitted coaster may be all one, monolithic piece of material. In other embodiments, the first tab is made from a different piece of material from the rest of the blank for the fitted coaster. In such an embodiment, the first tab is attached to the first lateral edge.

Second lateral edge 116 includes a second tab 120. Second tab 120 extends from second lateral edge 116. In some embodiments, the second tab is an extension of the second lateral edge. In such embodiments, the blank for the fitted coaster may be all one, monolithic piece of material. In other embodiments, the second tab is made from a different piece of material from the rest of the blank for the fitted coaster. In such an embodiment, the second tab is attached to the second lateral edge.

FIGS. 2-9 show fitted coaster 100 in an assembled configuration. During assembly, first sidewall 102 is folded at first connection zone 152 and second sidewall 104 is folded at second connection zone 154. First sidewall 102 and second sidewall 104 are folded toward each other such that first sidewall 102 and second sidewall 104 are perpendicular to base 156. Referring to FIG. 1, during assembly, first sidewall 102 and second sidewall 104 are folded toward each other in a direction that is away from the view in FIG. 1. First lateral edge 114 is brought into contact with third lateral edge 122. Second lateral edge 116 is brought into contact with fourth lateral edge 124. As previously mentioned, FIG. 1 shows the part of the blank that will become outer surface 170 of fitted coaster 100 when fitted coaster 100 is assembled. In the assembled condition, as shown in FIG. 2, the part of fitted coaster 100 not shown in FIG. 1 becomes the inner surface 270 in the assembled configuration. The blank shown in FIG. 10 can be assembled in the same way as the blank in FIG. 1. When assembled, fitted coaster 1000 has an inner surface 1170.

In some embodiments, the first and second tabs may be attached to the inner surface. For example, the first and second tabs may be adhered to the inner surface by an adhesive. In another example, the first and second tabs may be attached to the inner surface by mechanical connection, such as hook and loop fasteners. In some embodiments, the tabs may be attached to an outer surface of the fitted coaster.

FIGS. 1-9 illustrate an example of the first and second tabs being attached to the inner surface in the assembled configuration. FIG. 2 shows first tab 118 attached to inner surface 270 on second sidewall 104 at a region adjacent to third lateral edge 122. Second tab 120 is attached to inner surface 270 on second sidewall 104 at a region adjacent to fourth lateral edge 124.

FIGS. 10-17 illustrate another example of the first and second tabs being attached to the inner surface in the assembled configuration. FIG. 11 shows first tab 1018 attached to inner surface 1170 on second sidewall 1004 at a region adjacent to third lateral edge 1022. Second tab 1020 is attached to inner surface 1170 on second sidewall 1004 at a region adjacent to fourth lateral edge 1024.

In some embodiments, the fitted coaster may have one or more volume indicators. For example, fitted coaster 100 includes a first volume indicator 142 on first sidewall 102 and a second volume indicator 150 on second sidewall 104. The volume indicators can provide a view of a beverage container inserted within the fitted coaster. This way, a user or other person can see the level of fluid contained within the beverage container without removing the beverage container from the fitted coaster. For example, a server at a restaurant could see the level of fluid within a beverage container and can know when it is appropriate to offer a refill. As shown in FIGS. 1-9, the volume indicator may have an elongate shape with a longitudinal axis extending along a direction parallel with a lateral axis of the sidewalls. This shape and position makes the volume indicator show the level of fluid within a beverage container while remaining minimal so as not to interfere with the fit of the fitted coaster on the beverage container.

It is understood that the volume indicator may have a different shape or position. For example, a volume indicator may have a curved shape, such as an oval or s-shape. In some embodiments, the number of volume indicators may vary. For example, instead of having two volume indicators, as shown in FIGS. 1-9, a fitted coaster may have only one volume indicator. In another example, a fitted coaster may have three volume indicators. In some embodiments, a volume indicator may be made up of multiple windows stacked vertically one on top of the other on a sidewall of a fitted coaster.

Figure 9:
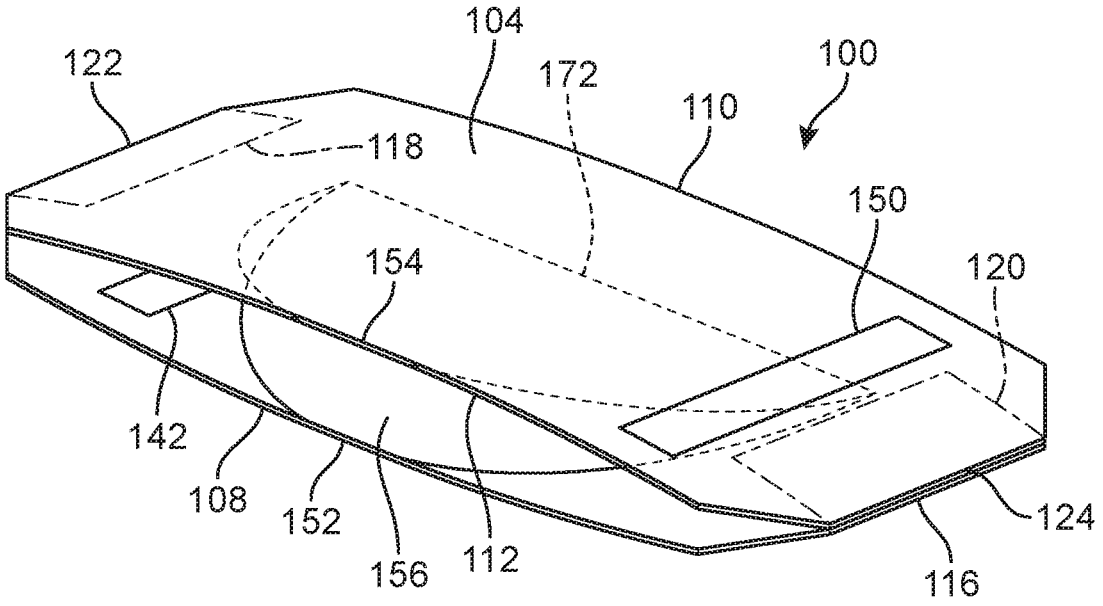
FIG. 9 is a view of a circular base of the assembled fitted coaster in a folded configuration.

The fitted coaster may be folded for storage and/or shipping, etc. For example, FIG. 9 illustrates fitted coaster 100 going into a folded position. In a folded position, the fitted coaster can be in the assembled or unassembled condition. FIG. 9 shows fitted coaster 100 folded while in the assembled condition. The base may fold inwardly to make the footprint of the base smaller during storage and/or shipping than if the base folded outwardly. For example, FIG. 9 shows how base 156 folds inwardly with respect to fitted coaster 100. The base may be perforated, have a slit, have a partial thickness cut, or be indented to facilitate folding the base inwardly. For example, base 156 has a perforation 172 that helps base 156 fold such that base 156 lies flat in a folded position. The third and fourth notches prevent the base from catching on the joint between the lateral edges when the base is folded inwardly and when the base is unfolded. Additionally, the first, second, third, and fourth notches help reduce bulk such that multiple folded fitted coasters can be neatly stacked. The notches further make the fitted coaster have a smaller footprint for shipping, storage, or placement on a work area, such as a bar counter.

Figure 18:
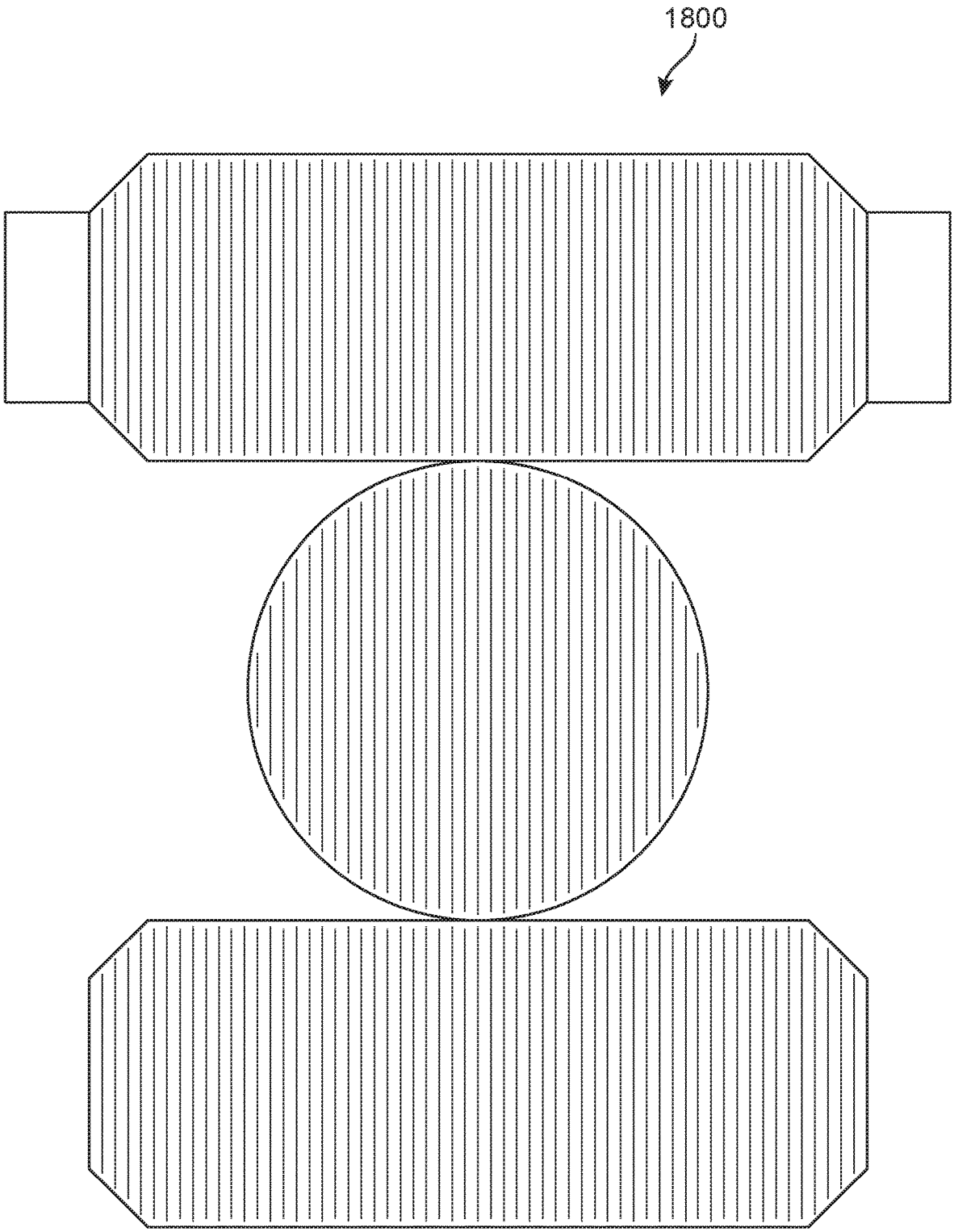
FIG. 18 is another embodiment of a blank of a fitted coaster in which a surface of the fitted coaster includes corrugation.
Figure 19:
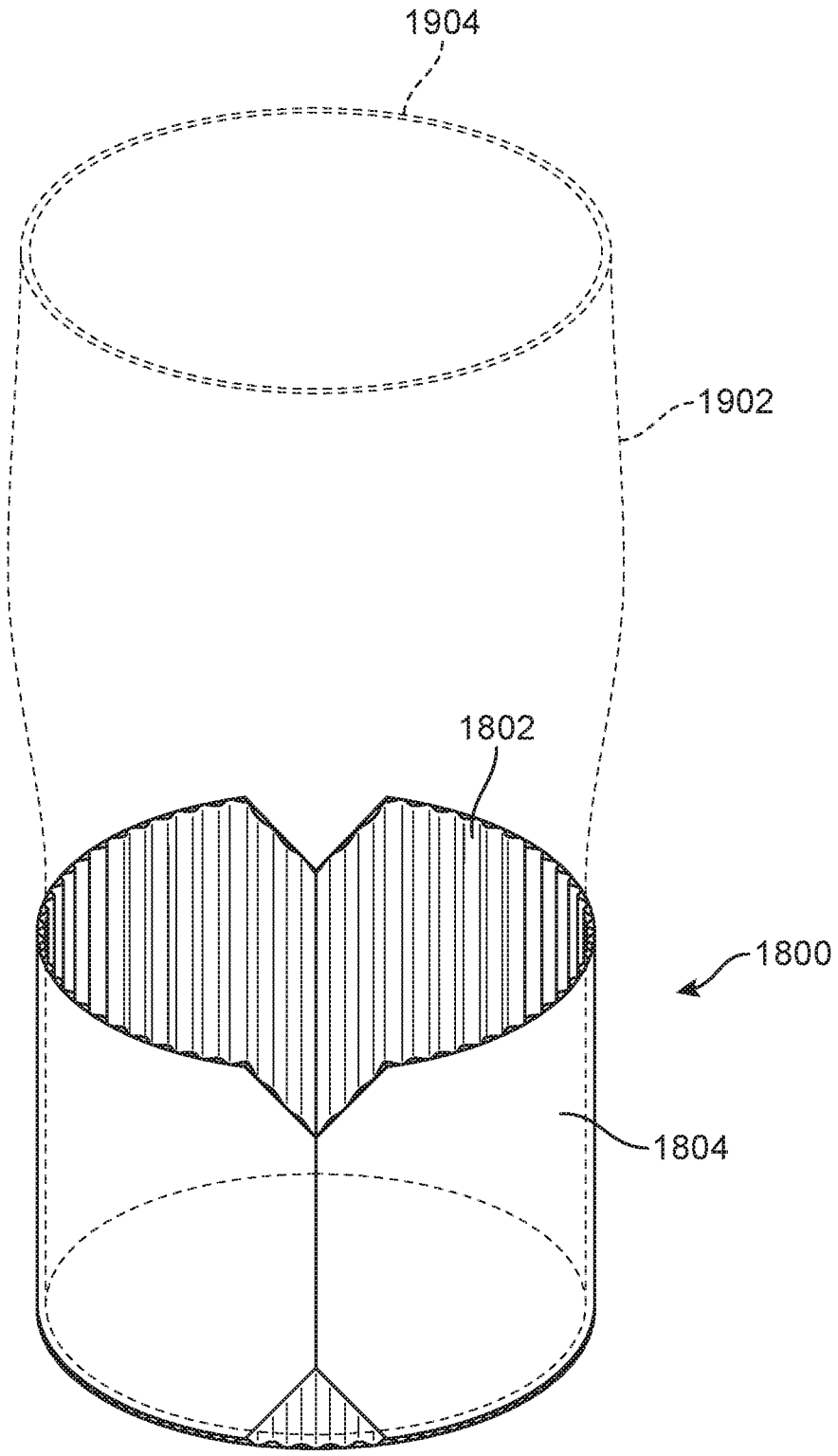
FIG. 19 is a perspective view of the assembled fitted coaster from FIG. 18 in combination with a beverage container.
Figure 21:
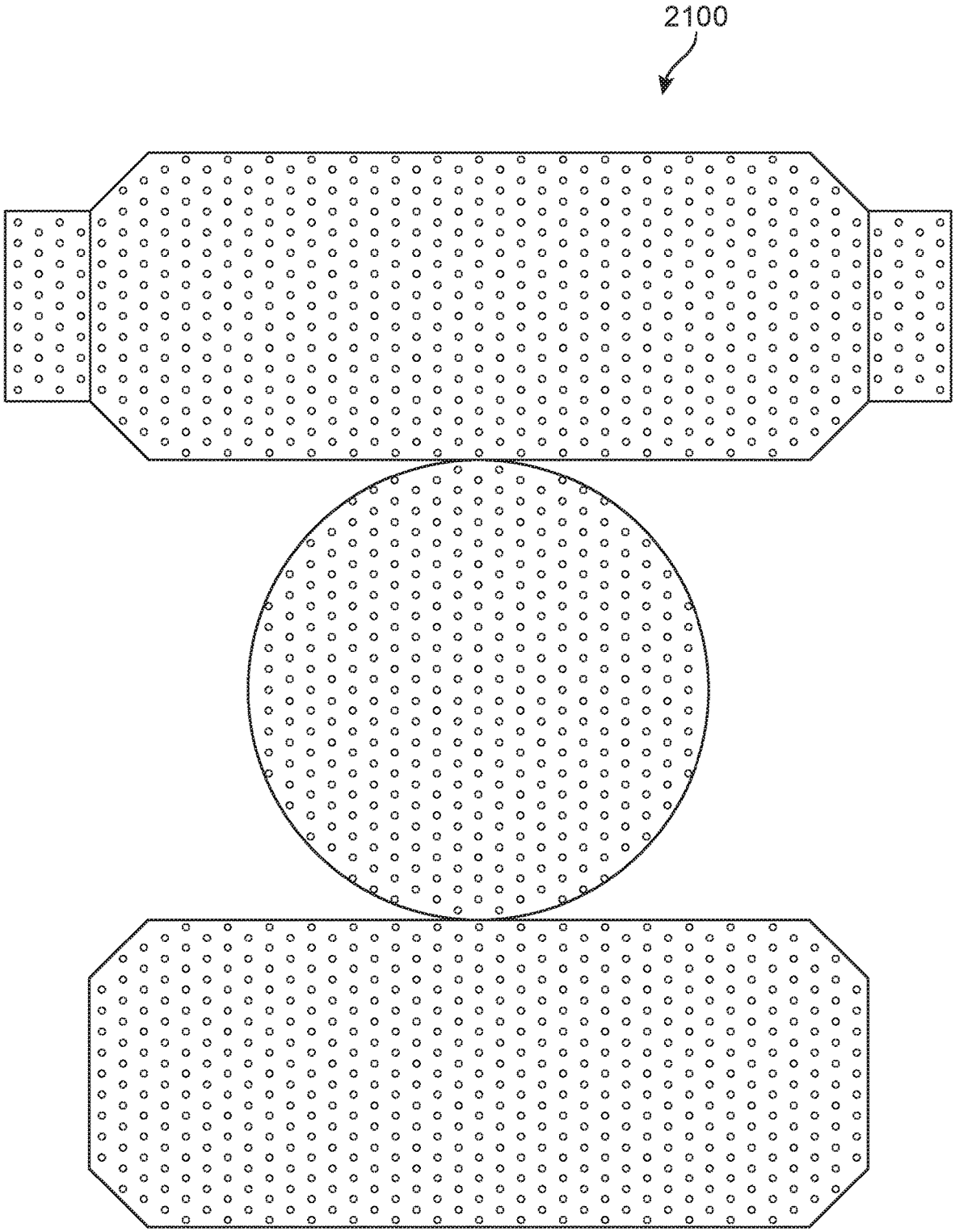
FIG. 21 is another embodiment of a fitted coaster.
Figure 22:
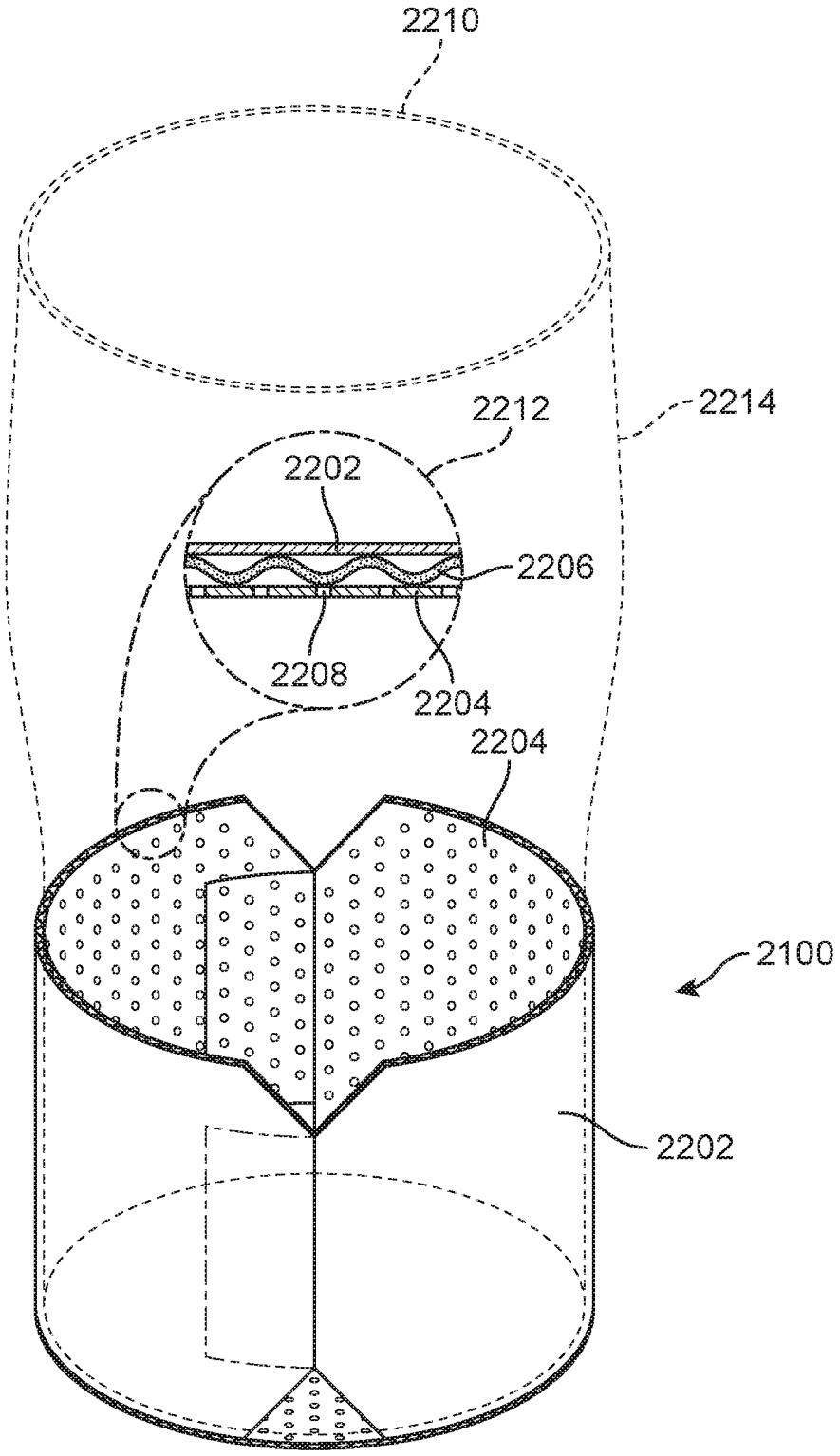
FIG. 22 is a perspective view of the fitted coaster from FIG. 21 assembled and in combination with a tapered beverage container.

The fitted coaster may be made from any suitable material. For example, the fitted coaster may be made of cardboard. The type of material used may depend on a variety of factors. For example, in some embodiments, cardboard may be selected to provide an absorbent material that is also recyclable and/or disposable. In another example, the type material may be selected based on the ability of the material to insulate against heat or cold, so that the user's hand stays comfortable holding a beverage container inserted within the fitted coaster. The inner and/or outer surface of the fitted coaster may be smooth, textured, embossed, or corrugated. For example, FIG. 18 shows a blank for a fitted coaster 1800. The surface showing in FIG. 18 is corrugated. As shown in FIG. 19, fitted coaster 1800 is assembled with the corrugated surface disposed on an inner surface 1802 of the assembled fitted coaster. In this embodiment, an outer surface 1804 of fitted coaster 1800 is smooth. In some embodiments, the fitted coaster may be assembled such that the corrugated surface is disposed on the outer surface of the assembled fitted coaster. In some embodiments, both sides of an assembled fitted coaster have the same texture. For example, the fitted coasters shown in FIGS. 1-9 and 10-17 include smooth inner and outer surfaces. In some embodiments, the fitted coaster may be made of multiple layers of material. For example, the fitted coaster may include a first layer of smooth cardboard forming an inner surface, a second layer of smooth cardboard forming an outer surface, and a corrugated cardboard layer sandwiched between the first smooth cardboard and the second smooth cardboard. For example, FIGS. 21-22 show a fitted coaster 2100 having a first smooth cardboard layer 2204 forming an inner surface, a second smooth cardboard layer 2202 forming an outer surface, and a corrugated cardboard layer 2206 sandwiched between the first smooth cardboard and the second smooth cardboard. FIG. 21 shows fitted coaster 2100 as a blank. FIG. 22 is a perspective view of the fitted coaster from FIG. 21 assembled and in combination with a tapered beverage container 2214 having a lip 2210. Zoomed in view 2212 shows the way outer surface 2202 and inner surface 2202 sandwich corrugated cardboard layer 2206 therebetween.

In some embodiments, the fitted coaster may have perforation holes for allowing air, moisture, and/or heat to escape from between a beverage container and the fitted coaster. In such embodiments, the fitted coaster may be made of multiple layers, and the perforation holes may only penetrate a single layer or multiple layers (e.g., all layers). For example, FIGS. 21-22 show an embodiment in which first smooth cardboard layer 2204 includes perforation holes 2208. Zoomed in view 2212 shows how perforation holes 2208 extend through first smooth cardboard layer 2204.

The size of the fitted coaster may vary with the beverage container it is meant to hold and/or for how much of the beverage container the fitted coaster is meant to cover. For example, as shown in FIG. 2, the fitted coaster covers less than half of the beverage container. In other embodiments, the fitted coaster may cover more than half of a beverage container. The dimensions of the sidewalls and base may be adjusted to adjust the size of the fitted coaster.

Figure 20:
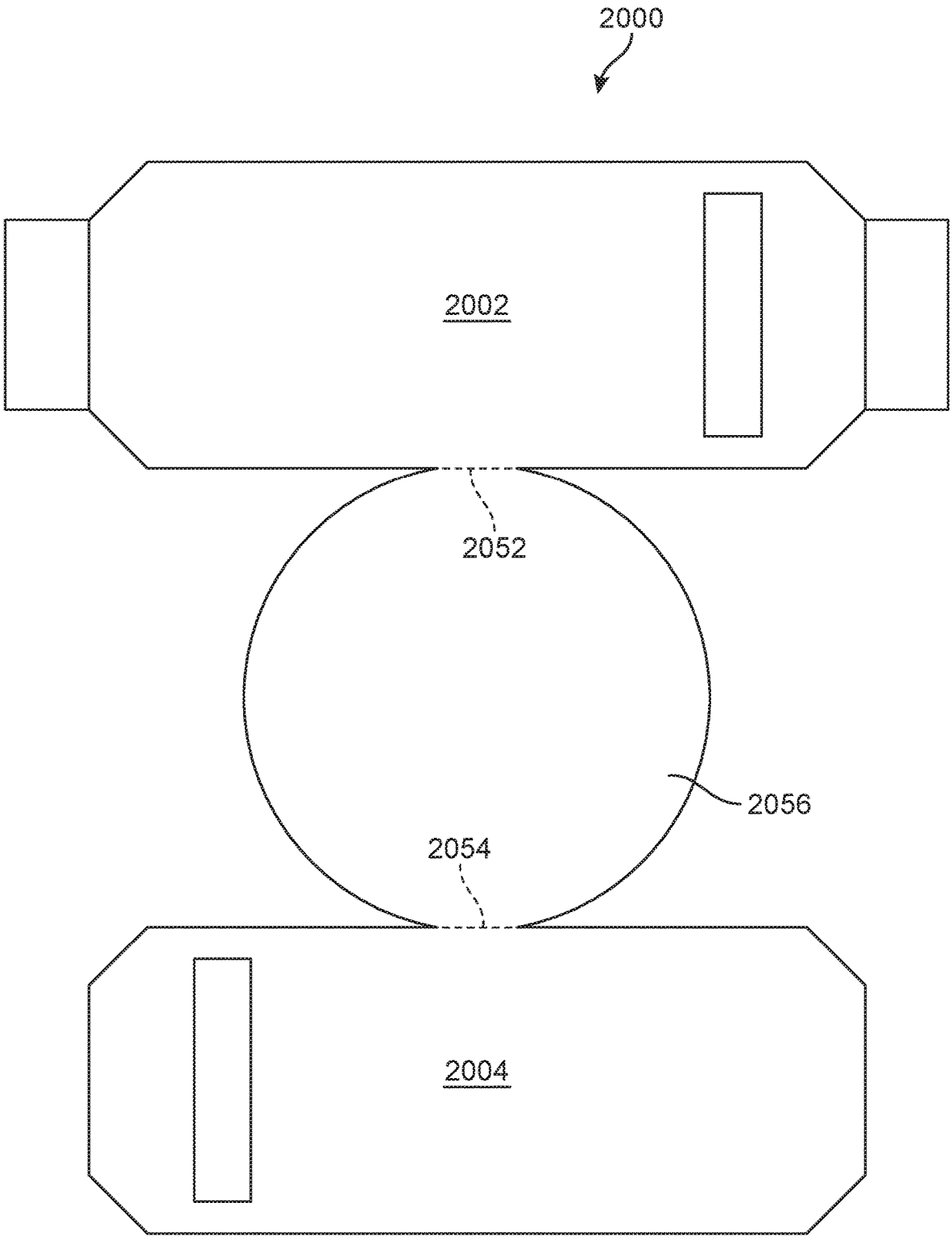
FIG. 20 is another embodiment of a fitted coaster.

In some embodiments, the connection zones may be perforated. For example, FIG. 20 shows an embodiment of a fitted coaster 2000 having a first connection zone 2052 and a second connection zone 2054. In this embodiment, first connection zone 2052 and second connection zone 2054 are perforated. These perforations make it easy for a first sidewall 2002 and a second sidewall 2004 to be removed from a base 2056. For example, a user may want to use only the sidewalls around a beverage container.

While various embodiments of the invention have been described, the description is intended to be exemplary, rather than limiting, and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. A fitted coaster for a beverage container, comprising:
- a base;
- a first sidewall extending substantially perpendicularly from the base, the first sidewall comprising:
  - a first lateral edge and a second lateral edge opposite the first lateral edge;
  - a first top edge and a first bottom edge opposite the first top edge;
  - a first slanted edge connecting the first lateral edge to the first bottom edge; and
  - a second slanted edge connecting the second lateral edge to the first bottom edge;
- a second sidewall extending substantially perpendicularly from the base, the second sidewall comprising:
  - a third lateral edge and a fourth lateral edge opposite the third lateral edge;
  - a second top edge and a second bottom edge opposite the second top edge, wherein the first lateral edge is attached to the third lateral edge and wherein the second lateral edge is attached to the fourth lateral edge;
  - a third slanted edge connecting the third lateral edge to the second bottom edge; and
  - a fourth slanted edge connecting the fourth lateral edge to the second bottom edge;
- a first notch formed by the first slanted edge and the third slanted edge at a point below the attachment between the first lateral edge and the third lateral edge; and
- a second notch formed by the second slanted edge and the fourth slanted edge at a point below the attachment between the second lateral edge and the fourth lateral edge.

2. The fitted coaster of claim 1, wherein the distance between the first top edge and the first bottom edge tapers toward the first lateral edge and toward the second lateral edge, such that the distance between the first top edge and the first bottom edge is shortest at both the attachment between the first lateral edge and the third lateral edge and the attachment between the second lateral edge and the fourth lateral edge;

wherein the distance between the second top edge and the second bottom edge tapers toward the second lateral edge and toward the second lateral edge, such that the distance between the second top edge and the second bottom edge is shortest at both the attachment between the first lateral edge and the third lateral edge and the attachment between the second lateral edge and the fourth lateral edge.

3. The fitted coaster of claim 2, wherein the fitted coaster has a folded position in which the base folds inwardly such that the base lies flat between the first sidewall and the second sidewall and wherein the first notch and second notch are configured such that the base may be pushed out from between the first sidewall and the second sidewall without resistance when the fitted coaster is moved from the folded position to an operative position in which the base is perpendicular to the first sidewall and the second sidewall.

4. The fitted coaster of claim 2, further comprising:
- a third notch disposed opposite the first notch along the first top edge.

5. The fitted coaster of claim 4, further comprising:
- a fourth notch disposed opposite the second notch along the second top edge.

6. The fitted coaster of claim 2, further comprising:
- a first tab extending from the first lateral edge, wherein the first tab attaches to the second sidewall; and a second tab extending from the second lateral edge, wherein the second tab attaches to the first sidewall.

7. The fitted coaster of claim 6, wherein the first notch is v-shaped as defined by the first slanted edge and the third slanted edge.

8. A fitted coaster for a beverage container, comprising:

a circular base;

a first sidewall extending substantially perpendicularly from the base, the first sidewall comprising:

a first lateral edge and a second lateral edge opposite the first lateral edge;

a first top edge and a first bottom edge opposite the first top edge;

wherein the distance between the first top edge and the first bottom edge tapers toward the first lateral edge and toward the second lateral edge, such that the distance between the first top edge and the first bottom edge is shortest at both the first lateral edge and the second lateral edge;

a second sidewall extending substantially perpendicularly from the base, the second sidewall comprising:

a third lateral edge and a fourth lateral edge opposite the third lateral edge;

a second top edge and a second bottom edge opposite the second top edge, wherein the first lateral edge is attached to the third lateral edge and wherein the second lateral edge is attached to the fourth lateral edge; and wherein the distance between the second top edge and the second bottom edge tapers toward the third lateral edge and toward the fourth lateral edge, such that the distance between the second top edge and the second bottom edge is shortest at both the third lateral edge and the fourth lateral edge.

9. The fitted coaster of claim 8, wherein the fitted coaster has a lip formed by the first top edge and the second top edge, the fitted coaster further comprising:

a first notch disposed along the lip.

10. The fitted coaster of claim 9, wherein the first notch is v-shaped.

11. The fitted coaster of claim 8, further comprising:

a first notch disposed along the first bottom edge at a position where the first lateral edge is attached to the third lateral edge.

12. The fitted coaster of claim 11, further comprising:

a first connection zone connecting the first sidewall to the base; and a second connection zone connecting the second sidewall to the base.

13. The fitted coaster of claim 12, wherein the first sidewall is unattached from the base at a first unattached region disposed between the first notch and the first connection zone and wherein the first sidewall contacts the base along the first unattached region.

14. The fitted coaster of claim 8, wherein the base is configured to fold inward between the first sidewall and the second sidewall.

15. A fitted coaster for a beverage container, comprising:

a blank from which the fitted coaster is assembled, the blank comprising:

a circular base;

a first sidewall extending from the circular base, the first sidewall comprising:

a first lateral edge and a second lateral edge opposite the first lateral edge;

a first top edge and a first bottom edge opposite the first top edge, wherein, in a disassembled condition, the first top edge is curved and the first bottom edge is straight, and the first bottom edge is connected to the circular base;

a second sidewall extending from the circular base, the second sidewall comprising:

a third lateral edge and a fourth lateral edge opposite the third lateral edge;

a second top edge and a second bottom edge opposite the second top edge, wherein, in a disassembled condition, the second top edge is curved and the second bottom edge is straight, and the second bottom edge is connected to the circular base.

16. The fitted coaster of claim 15, further comprising:

a first connection zone connecting the first sidewall to the circular base, wherein the first sidewall contacts the circular base at the first connection zone; and a second connection zone connecting the second sidewall to the circular base, wherein the second sidewall contacts the circular base at the second connection zone.

17. The fitted coaster of claim 15, wherein when the fitted coaster is assembled, the curvature of both the first top edge and the second top edge together with the straightness of both the first bottom edge and the second bottom edge causes a diameter of the fitted coaster to taper from the first and second top edges to the first and second bottom edges.

18. The fitted coaster of claim 17, wherein the distance between the first top edge and the first bottom edge tapers toward the first lateral edge and toward the second lateral edge, such that the distance between the first top edge and the first bottom edge is shortest at both the first lateral edge and the second lateral edge; and wherein the distance between the second top edge and the second bottom edge tapers toward the second lateral edge and toward the second lateral edge, such that the distance between the second top edge and the second bottom edge is shortest at both the third lateral edge and the fourth lateral edge.

19. The fitted coaster of claim 18, further comprising:

a first tab extending from the first lateral edge, wherein the first tab attaches to the second sidewall; and a second tab extending from the second lateral edge, wherein the second tab attaches to the first sidewall.

20. The fitted coaster of claim 15, wherein the blank is formed from at least two layers of material and wherein only one of the at least two layers has a plurality of perforation holes.

* * * * *